US005171396A

United States Patent [19]

Rank et al.

[11] Patent Number: 5,171,396

[45] Date of Patent: Dec. 15, 1992

[54] DEVICE FOR SPLICING PAPER WEBS FOR THE PRODUCTION OF CORRUGATED BOARD

[75] Inventors: Armin Rank, Waldau; Alfons Gnan, Vilseck, both of Fed. Rep. of Germany

[73] Assignee: BHS-Bayerische Berg-, Hutten- und Salzwerke Aktiengesellschaft, Fed. Rep. of Germany

[21] Appl. No.: 689,149

[22] Filed: Apr. 22, 1991

[30] Foreign Application Priority Data

Apr. 27, 1990 [DE] Fed. Rep. of Germany ..... 4013656

[51] Int. Cl.[5] ..... B32B 31/18

[52] U.S. Cl. ..... 156/502; 156/157; 156/159; 156/504; 156/505; 156/507

[58] Field of Search ..... 156/502, 504, 505, 507, 156/157, 159

[56] References Cited

U.S. PATENT DOCUMENTS

| | | | |
|---|---|---|---|
| 3,654,035 | 4/1972 | Takimoto | 156/505 |
| 3,837,954 | 9/1974 | Nudinger et al. | 156/507 |
| 3,841,944 | 10/1974 | Harris | 156/507 |
| 3,939,031 | 2/1976 | Takimoto | 156/505 |
| 4,170,506 | 10/1979 | Marschke . | |
| 4,190,475 | 2/1980 | Marschke . | |
| 4,219,378 | 8/1980 | Marschke | 156/505 |
| 4,481,053 | 11/1984 | Tokuno et al. | 156/505 |
| 4,738,739 | 4/1988 | Schoonderbeek . | |

FOREIGN PATENT DOCUMENTS

| | | |
|---|---|---|
| 2129903 | 1/1973 | Fed. Rep. of Germany . |
| 2008231 | 10/1973 | Fed. Rep. of Germany . |
| 2330945 | 1/1975 | Fed. Rep. of Germany . |
| 2712565 | 9/1977 | Fed. Rep. of Germany . |
| 2805076 | 8/1979 | Fed. Rep. of Germany . |
| 2919794 | 11/1979 | Fed. Rep. of Germany . |
| 3422170 | 4/1985 | Fed. Rep. of Germany . |
| 245855 | 5/1987 | Fed. Rep. of Germany . |
| 3816223 | 11/1989 | Fed. Rep. of Germany . |

OTHER PUBLICATIONS

Japanese Patent Abstracts, M-602, Jun. 26, 1987 vol. 11/No. 199.

*Primary Examiner*—Caleb Weston

*Attorney, Agent, or Firm*—Silverman, Cass & Singer, Ltd.

[57] ABSTRACT

A device for splicing paper webs for the manufacture of corrugated board. At least one pressing and redirecting roller is provided to receive the terminating web to be spliced from a web roll. Two clamping rollers, which function in an alternating manner, grasp the terminating web from the web roll. The clasping rollers are moveable from their initial positions to operating positions. A clamping beam, which functions in an alternating manner with one or the other clasping rollers, includes pressing faces disposed oppositely facing each other, there being one beam for each of the clasping rollers. Each clamping beam has a pressing face for pressing the web which runs across it. Two breaking beams alternatingly cooperate with the upper side of the clamping beam for one or the other clasping roller to bring the terminating web to rest. Two alternatingly functioning knives act to cut off the web which is played out. The clasping rollers are arranged on a wagon with a positive drive and adapted to be pushed along a straight horizontal track from a predetermined initial position into a predetermined operating position and back in the opposite direction. Each clasping roller can be moved back over a predetermined angle path from a position preparatory to the reception of the web beginning into a pressing position, in which position the web beginning, which is supplied with an adhesive coating, is disposed freely accessible over a predetermined length by its associated clamping beam.

10 Claims, 5 Drawing Sheets

$$b + c = \frac{1}{3} D \pi$$

DEVICE FOR SPLICING PAPER WEBS FOR THE PRODUCTION OF CORRUGATED BOARD

BACKGROUND OF THE INVENTION

1. Field of the Invention

This invention relates generally to a device for splicing paper webs, and in particular, to such a device for splicing paper webs used in the manufacture of corrugated board.

2. Description of the Prior Art

A device of the type with which this invention is concerned is disclosed in German patent DE-OS 38 16 223. In the said German patent, the webs which are to be spliced are played off of two web rolls which are arranged on an exchange stand. The terminating web is led by a pressing and redirecting roller which is vertically movable and runs out across a storage loop to a subsequent work station. The new web which is to be spliced thereto is fastened in its initial position by its lead edge to a clasping roller and is cut by a knife. The lead edge of the web is secured by a clamping beam and is led into an operating position below one of two pressing and redirecting rollers. After the movement of the terminating web is stopped by a breaking beam, the end of the terminating web is secured to the beginning of the new web by the lowering of the pressing and redirecting rollers and is held tight by an adhesive strip. At this time the first web, which is terminating, is cut off. After the return of the pressing and redirecting rollers and of the breaking beam into their initial position, the new web is played off.

The purpose of the present invention is to improve the preparation, the clasping, and the binding of the beginning of a new web to the terminating web. In so doing, the preparation is made easier, the clasping is improved, and the placement of the beginning of the new web onto the terminating web takes place with greater precision.

SUMMARY OF THE INVENTION

The invention is characterized by a device for splicing webs, in particular, paper webs for the manufacture of corrugated board. At least one pressing and redirecting roller is provided to receive the terminating web to be spliced from a web roll. Two clasping rollers, which function in an alternating manner, grasp the terminating web from the web roll. The clasping rollers are moveable from their initial positions to operating positions. A clamping beam, which functions in an alternating manner with one or the other clasping rollers, includes pressing faces disposed oppositely facing each other, there being one beam for each of the clasping rollers. Each clamping beam has a pressing face for pressing the web which runs across it. Two breaking beams alternatingly cooperate with the upper side of the clamping beam for one or the other clasping roller to bring the terminating web to rest. Two alternatingly functioning knives act to cut off the web which is played out. The clasping rollers are arranged on a wagon with a positive drive and adapted to be pushed along a straight horizontal track from a predetermined initial position into a predetermined operating position and back in the opposite direction. Each clasping roller can be moved back over a predetermined angle path from a position preparatory to the reception of the web beginning into a pressing position, in which position the web beginning, which is supplied with an adhesive coating, is disposed freely accessible over a predetermined length by its associated clamping beam.

The particular clasping roller which is to receive the beginning of the new web is brought into an initial position where the beginning of the web is presented in the proper position. The web is held fast by the clasping roller with clamping beams, is cut in a predetermined position and provided with an adhesive strip of a predetermined width. After the clasping roller is moved into the operating position, the proper orientation to the terminating web can be achieved, so that a splice with a residual stub can be avoided.

DESCRIPTION OF THE PREFERRED EMBODIMENT

Figure 1:
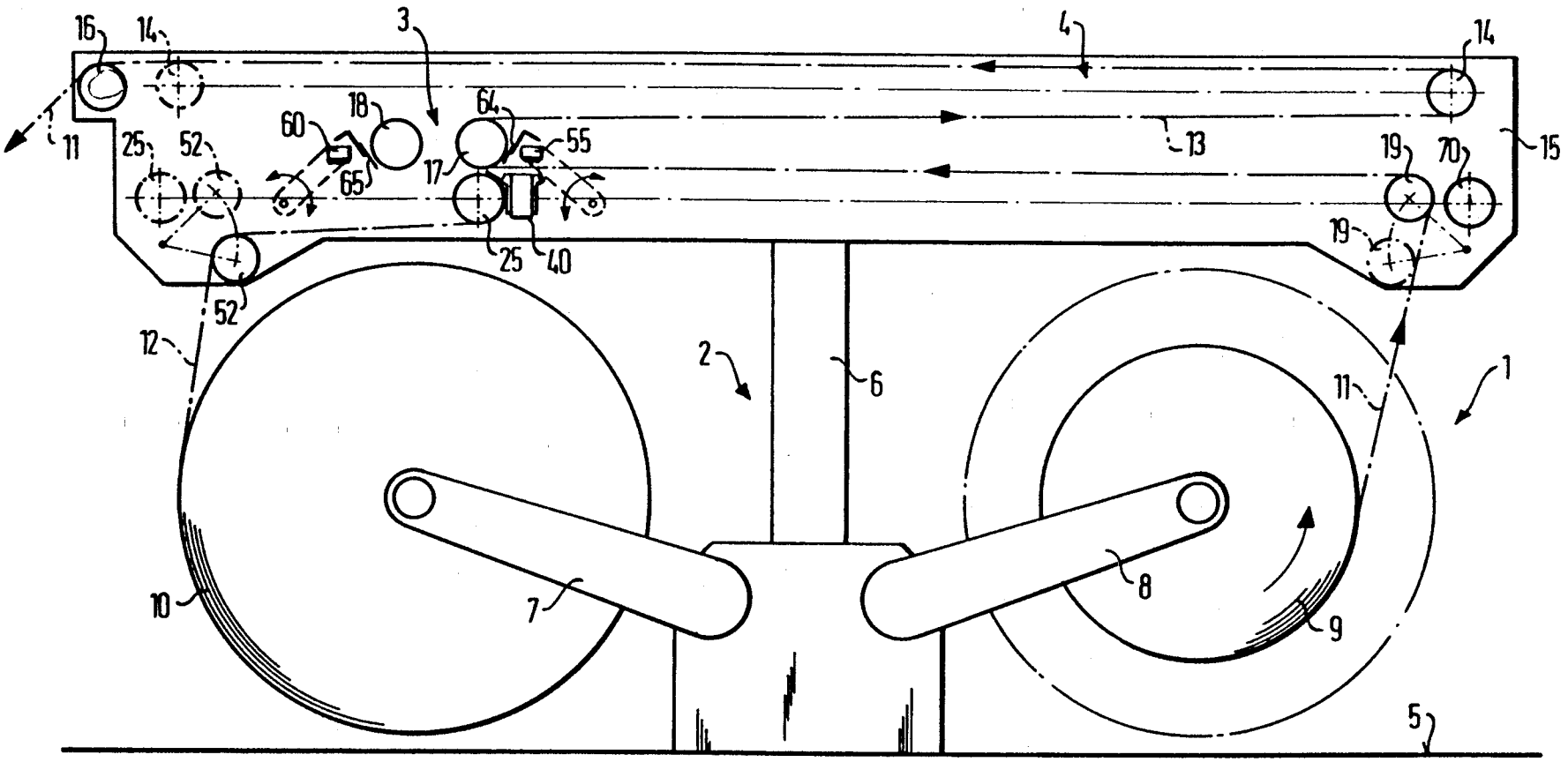
FIG. 1 is a schematic side view of the device of the invention showing a terminating paper web which is playing off of a roll on the right side, whereby the beginning of the web which is being pulled off of a roll on the left side is in the operating position for bonding to the terminating web.

The device 1 for splicing of paper webs comprises a web unroller 2, a splice device 3 and web storage member 4.

The web unroller 2 includes a stand 6 which can be fastened to the floor 5. The web unroller 2 also includes lateral bearing arms 7, 8 for the web rolls 9, 10. Looking at FIG. 1, the web 11 is playing out off of the right web roll 9. A new web 12 is fed from the web roll 10, the beginning of which is to be bonded to the end of terminating web 11.

Since the terminating web 11 is stopped briefly during the splicing of the two webs 11 and 12, the splice device 3 is provided with web storage member 4 having at least one web loop 13. To form the web loop 13, the terminating web 11 runs from the splice device 3 to a redirecting roller 14, which is supported by a wagon (not shown). The wagon can be moved against a controllable force from an initial position depicted in FIG. 1 at the right end of the cheeks on the stand 6 into the position shown in dotted line at the left end of the cheeks 15. The terminating web 11 then emerges at the left end of the cheek 14 through the exit roller 16 in the direction indicated at the upper left end of FIG. 1. From there the web 11 moves to a processing station, not shown, for example to a single-sided corrugated board machine.

The supply of terminating web 11 formed by the storage loop 13 is dimensioned such that the operation of the subsequent work station can continue to function at constant operating speed during the splicing process.

Two pressing and redirecting rollers 17, 18 are arranged side by side at the side cheeks 15, off center toward the exit roller 16. The terminating web 11 passes over a redirecting roller 19, which can be swung about, situated above the right end of the cheeks 15 to the pressing and redirecting roller 17 and from there to the storage roller 14 and finally to the exit roller 16.

Figure 3:
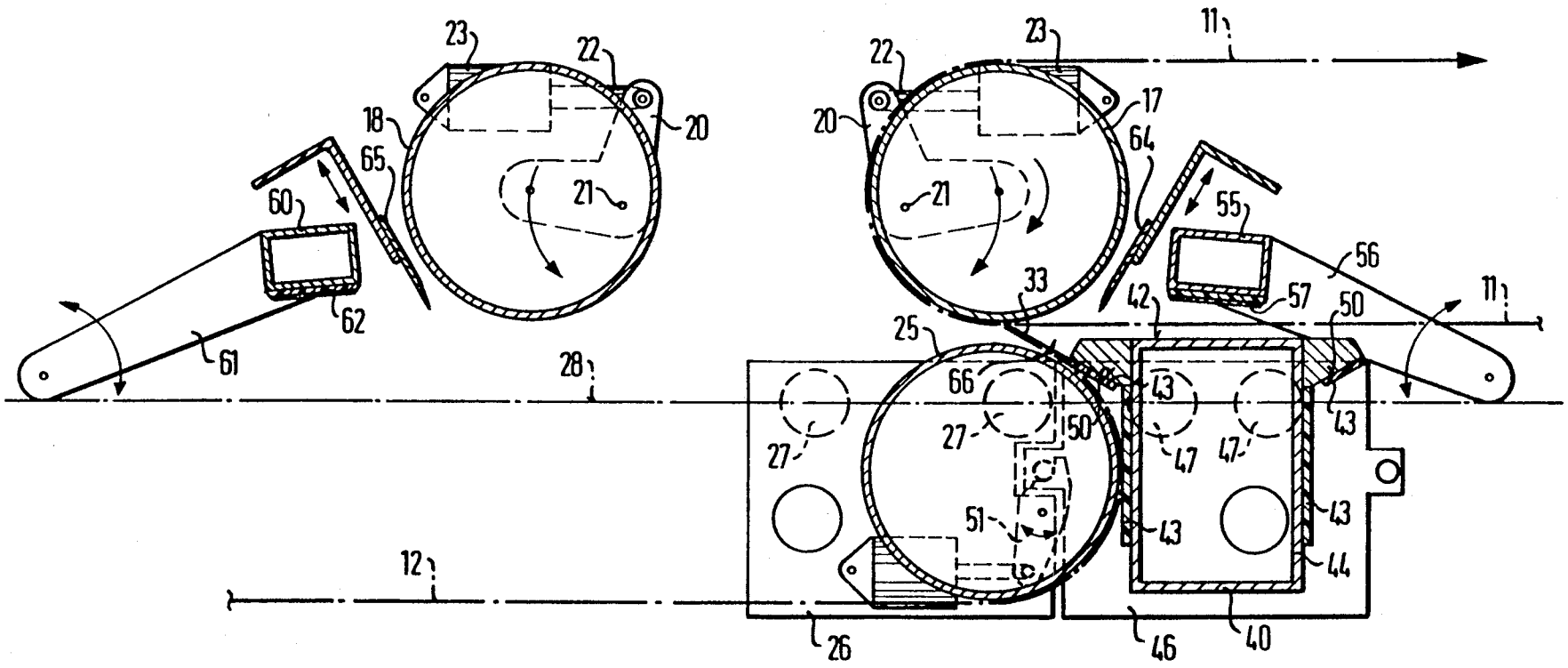
FIG. 3 is an enlarged partial side view of the invention.

As seen in FIG. 3, the two pressing and redirecting rollers 17, 18 can be swung up and down to a limited extent. For this purpose, the center axes of rollers 17, 18 are mounted on lateral angle levers 20. The angle levers 20 can be pivoted about their swing axes. The free ends of the angle levers 20 are connected to piston rods 22 of a pneumatic drive cylinder 23.

In the position represented in FIG. 1, a clasping roller 25 is positioned beneath the pressing and redirecting roller 17. The clasping roller 25 is positioned, as shown in FIG. 3, in such a manner that it can be rotated in a wagon 26, which can be driven along a straight, horizontal track 28 by means of rollers 27 which effect positive wagon drive from the working position shown in solid line in FIG. 1 to the dotted line position at the left end thereof.

Figure 4:
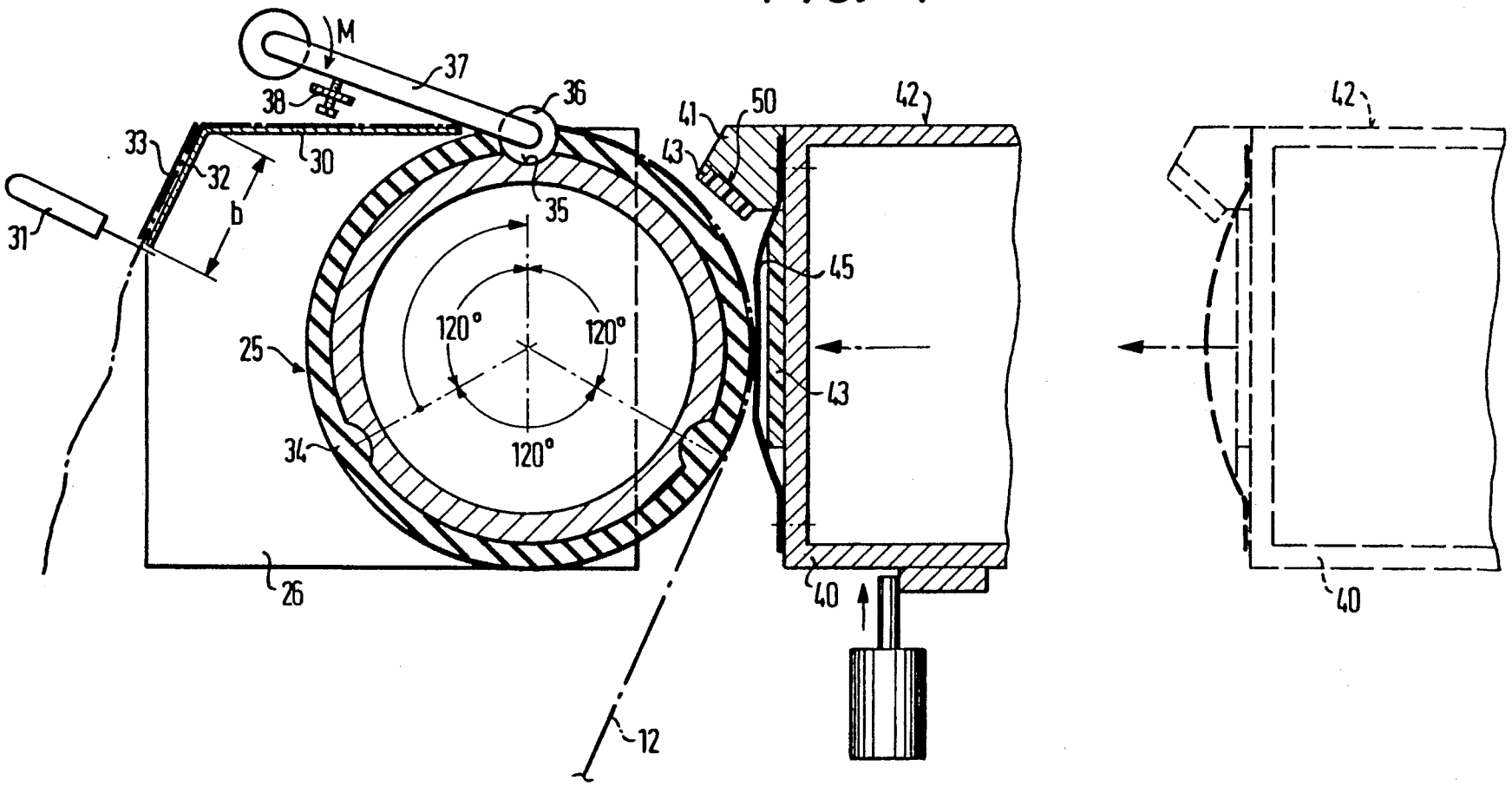
FIG. 4 is a partial side view thereof with the clasping roller and clamping beams in their initial position for clasping the beginning of the web.

As seen in FIG. 4, the wagon 26 for the clasping roller 25 includes an exterior sheet metal plate 30 with a bent down edge 32. The new web 12 is drawn by its lead edge from beneath the clasping roller 25 and then across the adjoining sheet metal plate 30. The excess end piece of the new web 12 is cut off manually or by machine flush with the end of the sheet metal plate 30.

A double sided adhesive strip 33 is applied to the beginning of the new web 12 across the length b of the bent down edge 32. The clasping roller 25 is provided about its circumference with a coating of gum 34 having a high coefficient of friction.

Catch notches 35 are arranged about the circumference of the clasping roller 25 at intervals of 120°. Catch rollers 36 mounted on a catch lever 37, which is firmly fixed to the cheeks 15, are adapted to engage into catch notches 35. In the position shown in FIG. 4, the catch roller 36 of catch lever 37 engages into the catch notch 35.

The clasping roller 25 is provided with a clamping beam 40. Clamping beam 40 is of generally rectangular cross-sectional configuration with projecting shoulders 41 on the upper long edges thereof. The upper side 42 of beam 40 is horizontal and flat. The side walls 44 and the face 50 of the shoulders 41 are provided with an elastic friction coating 43. The elastic friction coatings 43 on the side walls 44 are covered over by spaced steel leaf springs 45.

In the initial position depicted in FIG. 4, the wagon 46 provided with the clamping beams 40—the wagon being capable of being moved above the rolls 47 by means of a compressed air motor 48 directed across the web 28—is brought close to the clasping roller 25 in such a manner that the leaf springs 45 are lightly pressed into contact with the clasping roller 25. In this manner, the web 12 is held tight.

Figure 5:
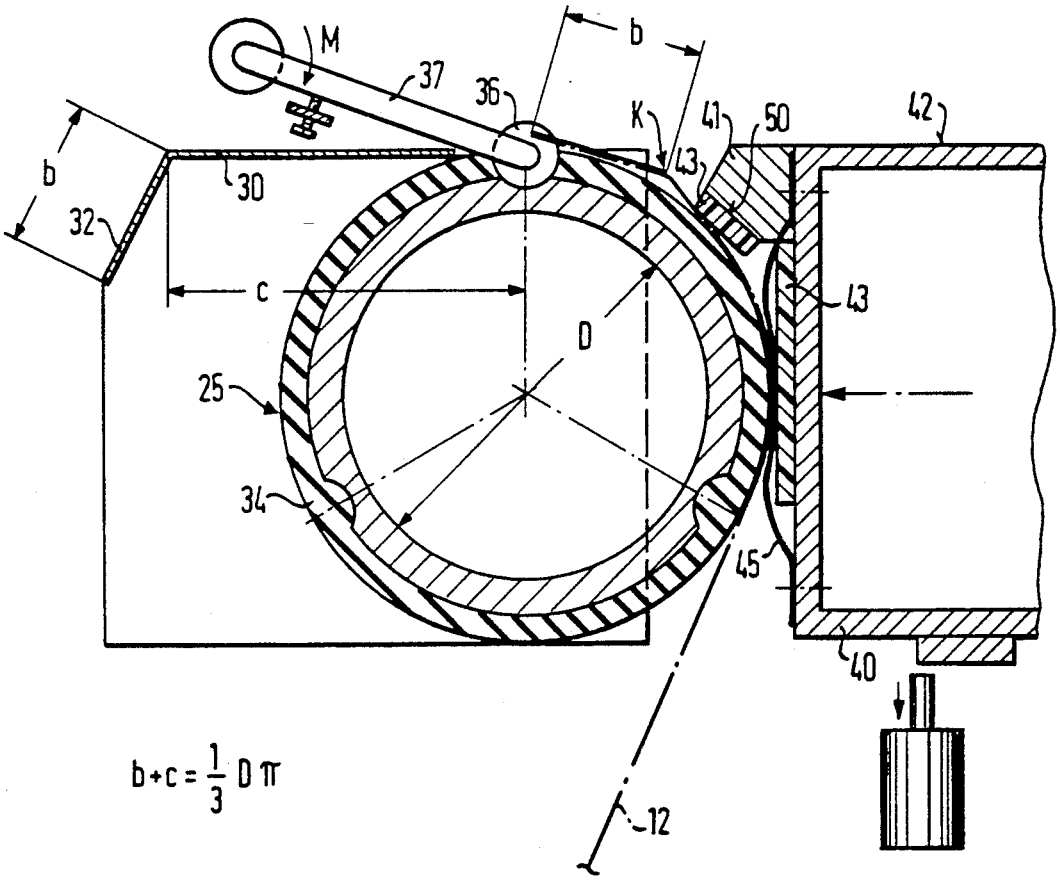
FIG. 5 is a partial side view thereof with the clasping roller shown rotated back and latched with a web beginning clamped fast in its initial position.

The clasping roller 25 can then be rotated back clockwise 120° by a drive motor or by hand, bringing the leading edge of the beginning web 12 to the face 50 of the shoulder 41 at a distance b (compare FIG. 5). During this process, the beginning of web 12 remains in unchanged position on the clasping roller 25, because the coefficient of friction of the gum coating 34 of the clasping roller 25 is greater than that of the leaf springs 45. Then the wagon 46 for the clamping beam 40 is moved in the direction of the clasping roller 25, causing the elastic coatings to be pressed onto the new web 12 and thereby onto the clasping roller 25. The two wagons 26 and 46 are then bolted together by a remotely controlled latch 51.

In said latched position of the wagons 26 and 46, the clasping roller 25 and the clamping beam 40 are moved from the initial position to the fully extended operating position depicted in FIG. 1. Prior to this, the redirecting roller 52 is moved over into its lowered position.

The pressing and redirecting roller 17 is further provided with a breaking beam 55 which is adjustable in height. The breaking beam 55 can be pivoted by means of a pivot lever 56. The underside of the breaking beam 55 is provided with an elastic breaking coating 57.

In the working position, the breaking coating 57 of the breaking beam 55 works together with the terminating web 11 and presses it against the upper side 42 of the clamping beam 40. In this manner, the terminating web 11 is brought to rest.

The pressing and redirecting roller 18 is likewise provided with a breaking beam 60 having pivot levers 61 and breaking coating 62. This breaking beam 60 functions together with the clasping roller 70 when the latter is in operating position below the pressing and redirecting roller 18. This is the case when, as can be seen from FIG. 2, the terminating web 11 moves from the left roll 10 and the new web 12, which is to be attached, from the right roll 9.

Each pressing and redirecting roller 17, 18 is further provided with an impact knife 64, 65 which is arranged diagonally and which cuts into the space 66 between the rollers 17, 25, or 18, 70. Each impact knife 64, 65 can be shifted in the direction indicated by the arrows shown in FIG. 3. The impact knives serve &o cut off the terminating web 11, whereby the stub of the length b, which remains between the roller 17 or 18 and the cut of the knife, corresponds to the adhesive strip at the beginning of the new web 12.

As seen in FIG. 1, there is an additional clasping roller 70 which serves to receive and hold fast the beginning of the new web 12 when it comes from the roller 9. The clasping roller 70 is also arranged on a wagon with latch in the same manner as roller 25 and can likewise be moved across track 28.

Figure 2:
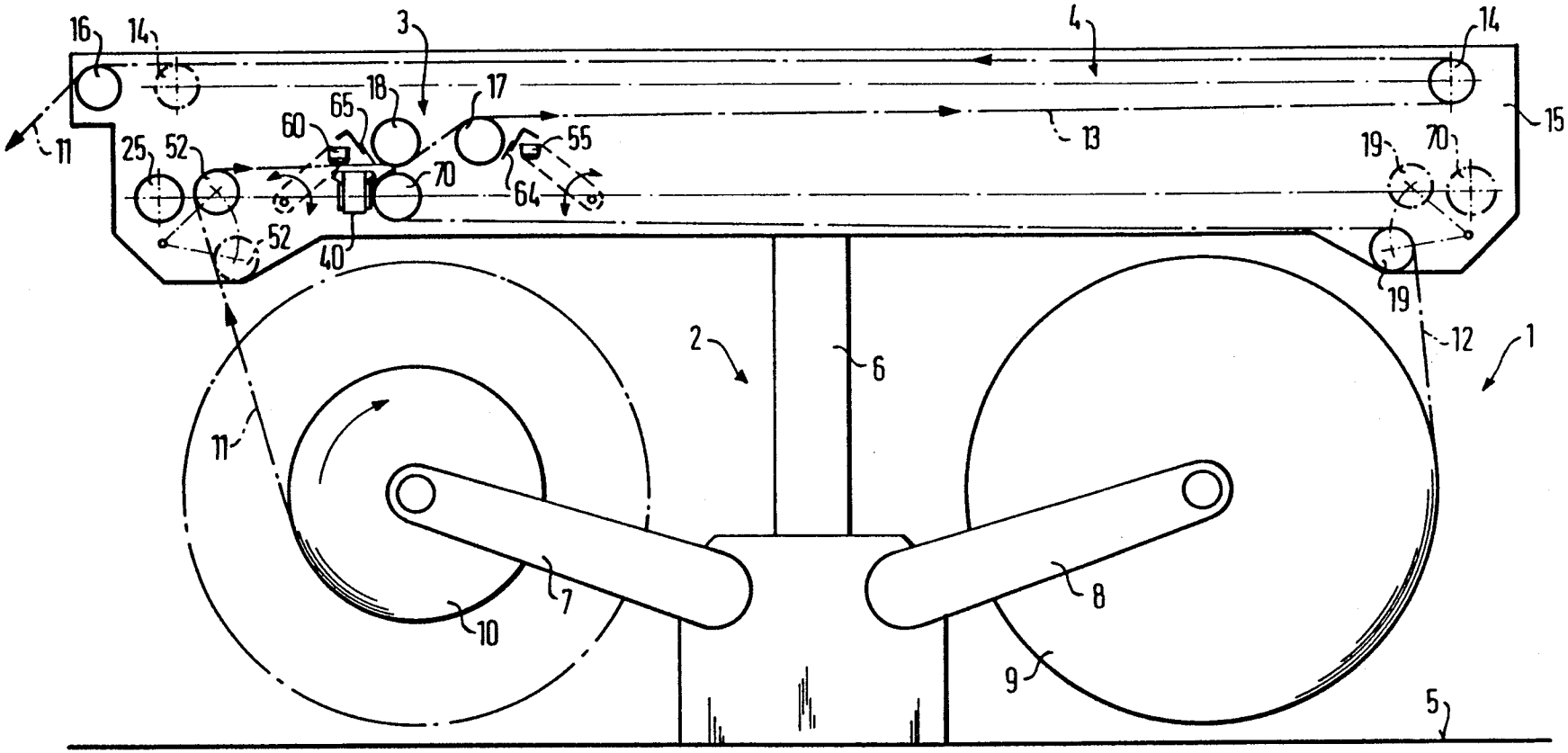
FIG. 2 is a view similar to that of FIG. 1, but in which the terminating web is shown on the left roll and the beginning of the new web is shown coming from the right roll and is in operating position for bonding to the terminating web.

The redirecting roller 19 is arranged so that it can be swung down, in the same manner as redirecting roller 52. When splicing is to be effected, the lowered pressing and redirecting roller 17 presses the firmly held terminating web 11 against the clasping roller 25, the impact knife 64 cuts off the web 11, whereupon the breaking beam 55 swings up, the clamping beam 40 is released from its latched position but remains in close proximity to the clasping roller 25, the rollers 17 and 25 move into a position pressing against each other by means of the movement on the track, and finally the roller 17 is also swung up. In the same manner, the splicing operation can be accomplished as shown in FIG. 2.

Minor variations in the structure and other variations in the arrangement and size of the various parts may occur to those skilled in the art without departing from the spirit or circumventing the scope of the invention as set forth in the appended claims.

We claim:

1. Apparatus for splicing paper webs comprising, at least one pressing roller and one redirecting roller for feeding a terminating edge of a web from a web roll, two clasping rollers operable in an alternating manner to catch the terminating edge of the web to be spliced from said web roll, said clasping rollers being movable from initial positions to operating positions, a clamping beam operable in an alternating manner with one or the other clasping roller, said clamping beam including pressing faces disposed across from each other for each of the clasping rollers and a pressing face across which the web is adapted to run, two breaking beams operable alternatively with an upper side of the clamping beam for one or the other clasping roller to bring the terminating edge of said web to rest, two alternatingly operable knives to sever the terminating edge of the web, said clasping rollers being arranged on a wagon having a positive drive to move along a straight horizontal track from a predetermined initial position into a predetermined operating position and back, each clasping roller being movable through a predetermined angle path from a position preparatory to the reception of the beginning of another web into a pressing position in which said beginning of the other web having an adhesive coating thereon is freely accessible over a predetermined length of the clamping beam, each clasping roller having a coating of gum on its circumference with a high coefficient of friction, each clasping roller being arranged in a first wagon with positive drive, said first wagon being movable along a horizontal straight track from a working position to a predetermined initial position, said clamping beam being arranged in a second wagon which is movable toward said first wagon.

2. Apparatus as claimed in claim 1 in which each clasping roller includes a plate having a folded down portion of said predetermined length.

3. Apparatus as claimed in claim 2 including a knife extending from a terminating edge of the folded down portion of the plate.

4. Apparatus as claimed in claim 1 in which each clasping roller includes a plurality of catch notches positioned about the circumference of the roller spaced 120° with respect to each other and a fixed catch lever having a catch roller positioned for meshing engagement into a selected notch presented at the top of the roller.

5. Apparatus as claimed in claim 1 in which the clamping beam includes lateral shoulders and side faces with friction coatings.

6. Apparatus as claimed in claim 5 in which the friction coatings of the side faces are spanned by leaf springs.

7. Apparatus as claimed in claim 1 in which the knives for severing the terminating edge of the web are arranged separate from the clamping beam for cutting into the space between the pressing and redirecting rollers and the clasping rollers.

8. Apparatus for splicing webs comprising, at least one pressing roller and one redirecting roller for feeding a terminating edge of a web from a web roll, two clasping rollers operable in an alternating manner to catch the terminating edge of the web to be spliced from said web roll, said clasping rollers being movable from initial positions to operating positions, a clamping beam operable in an alternating manner with one or the other clasping rollers, said clamping beam including pressing faces disposed across from each other for each of the clasping rollers and pressing face across which the web is adapted to run, two breaking beams operable alternatively with an upper side of the clamping beam for one or the other clasping roller to bring the terminating edge of said web to rest, two alternatingly operable knives to sever the terminating edge of the web, said clasping rollers being arranged on a wagon having a positive drive to move along a straight horizontal track from a predetermined initial position into a predetermined operating position and back, each clasping roller being movable through a predetermined angle path from a position preparatory to the reception of the beginning of another web into a pressing position in which said beginning of the other web having an adhesive coating thereon is freely accessible over a predetermined length of the clamping beam, the clamping beam including lateral shoulders and side faces with friction coatings, the friction coatings being spanned by leaf springs.

9. Apparatus for splicing paper webs comprising, at least one pressing roller and one redirecting roller for feeding a terminating edge of a web from a web roll, two clasping rollers operable in an alternating manner to catch the terminating edge of the web to be spliced from said web roll, said clasping rollers being movable from initial positions to operating positions, a clamping beam operable in an alternating manner with one or the other clasping roller, said clamping beam including pressing faces disposed across from each other for each of the clasping rollers and a pressing face across which the web is adapted to run, two breaking beams operable alternatively with an upper side of the clamping beam for one or the other clasping roller to bring the terminating edge of said web to rest, two alternatingly operable knives to sever the terminating edge of the web, said clasping rollers being arranged on a wagon having a positive drive to move along a straight horizontal track from a predetermined initial position into a predetermined operating position and back, each clasping roller being movable through a predetermined angle path from a position preparatory to the reception of the beginning of another web into a pressing position in which said beginning of the other web having an adhesive coating thereon is freely accessible over a predetermined length of the clamping beam, each clasping roller including a plurality of catch notches positioned about the circumference of the roller spaced 120° with respect to each other and a fixed catch lever having a catch roller positioned for meshing engagement into a selected notch presented at the top of the roller.

10. Apparatus for splicing paper webs comprising, at least one pressing roller and one redirecting roller for feeding a terminating edge of a web from a web roll, two clasping rollers operable in an alternating manner to catch the terminating edge of the web to be spliced from said web roll, said clasping rollers being movable from initial positions to operating positions, a clamping beam operable in an alternating manner with one or the other clasping roller, said clamping beam including pressing faces disposed across from each other for each of the clasping rollers and a pressing face across which the web is adapted to run, two breaking beams operable alternatively with an upper side of the clamping beam for one or the other clasping roller to bring the terminating edge of said web to rest, two alternatingly operable knives to sever the terminating edge of the web, said clasping rollers being arranged on a wagon having a position drive to move along a straight horizontal track from a predetermined initial position into a predetermined operating position and back, each clasping roller being movable through a predetermined angle path from a position preparatory to the reception of the beginning of another web into a pressing position in which said beginning of the other web having an adhesive coating thereon is freely accessible over a predetermined length of the clamping beam, each clasping roller including a plate having a folded down portion of said predetermined length.

* * * * *